US005723430A

United States Patent [19]

Mihelic

[11] Patent Number: 5,723,430

[45] Date of Patent: Mar. 3, 1998

[54] MICROEMULSION CLEANERS HAVING DECREASED ODOR

[75] Inventor: Joseph Mihelic, Sparta, N.J.

[73] Assignee: Ashland Inc., Columbus, Ohio

[21] Appl. No.: 732,124

[22] Filed: Oct. 15, 1996

Related U.S. Application Data

[63] Continuation of Ser. No. 371,075, Jan. 10, 1995, abandoned.

[51] Int. Cl.[6] ..... C11D 1/72; C11D 1/83; C11D 3/30; C11D 3/36

[52] U.S. Cl. ..... 510/417; 510/273; 510/421; 510/423; 510/436; 510/499

[58] Field of Search ..... 510/273, 417, 510/421, 423, 436, 499

[56] References Cited

U.S. PATENT DOCUMENTS

| | | | |
|---|---|---|---|
| 3,887,497 | 6/1975 | Ulvild | 252/526 |
| 3,928,065 | 12/1975 | Savino | 134/7 |
| 4,436,653 | 3/1984 | Jacobson et al. | 252/547 |
| 4,689,201 | 8/1987 | Longworth | 422/16 |
| 4,857,114 | 8/1989 | Brumbaugh | 134/42 |
| 5,158,710 | 10/1992 | Van Eenam | 252/539 |
| 5,281,354 | 1/1994 | Faber | 252/154 |
| 5,336,445 | 8/1994 | Michael et al. | 252/548 |
| 5,376,298 | 12/1994 | Michael | 252/153 |
| 5,401,325 | 3/1995 | Mihelic et al. | 134/39 |
| 5,401,326 | 3/1995 | Mihelic et al. | 134/40 |

*Primary Examiner*—Paul Lieberman
*Assistant Examiner*—Gregory R. Delcotto
*Attorney, Agent, or Firm*—David L. Hedden

[57] ABSTRACT

This invention relates to microemulsion cleaners having decreased odor comprising (a) an organic solvent (b) a nonionic surfactant blend (c) a glycol ether (d) a phosphate ester hydrotrope or salt thereof (e) primary amino alcohol, and (f) water. These cleaners can be used for removing baked-on oil and carbon deposits.

8 Claims, No Drawings

MICROEMULSION CLEANERS HAVING DECREASED ODOR

This application is a continuation of application Ser. No. 08/371,075, filed on Jan. 10, 1995, now abandoned.

FIELD OF THE INVENTION

This invention relates to microemulsion cleaners having decreased odor comprising (a) an organic solvent (b) a nonionic surfactant blend (c) a glycol ether (d) a phosphate ester hydrotrope hydrotrope or salt thereof (e) a primary amino alcohol, and (f) water. These cleaners can be used for removing oil, grease, and baked-on carbon deposits from metal surfaces.

BACKGROUND

The importance of industrial and marine cleaners which clean metal parts effectively is clearly recognized. Although such cleaners are available in the marketplace, there is a need for improved cleaners which can be easily handled and used. Typically the cleaners used for such applications are either solutions or macroemulsion cleaners. However, there are disadvantages in using such products.

One of the major disadvantages of these macroemulsion cleaners is that they are not convenient to use since they must be prepared as a water emulsion just prior to use due to the instability of the macroemulsion. Water emulsions are cumbersome to use and a significant source of cleaning failures, especially under shipboard conditions, because they break into two phases. Furthermore, mixing can result in inconsistent results due to variations in the concentration of components of the macroemulsion as prepared.

Another major disadvantage of such cleaners is that they are milky emulsions which leave milky residues on cleaned equipment and require a further water rinse which is undesirable.

Additionally, solution cleaners based upon solvents, and even many macroemulsion cleaners often have low flash points which can be unsafe when the cleaners are used for cleaning hot equipment, particularly air coolers on diesel engine trains. The air cooler of a diesel train is conventionally cleaned using such a freshly prepared macroemulsion in water. The water is added to eliminate the flash point, which would otherwise create a potential hazard on the hot equipment.

Even so, due to the vagaries in macroemulsion preparation on shipboard just prior to use, a potentially hazardous flashpoint may occur. Usually these macroemulsion cleaners are stable for only a few hours. Consequently, if the personnel involved in the cleaning are suddenly needed elsewhere during the course of the air cooler cleaning treatment or do not carry out the macroemulsification properly, the emulsion and water could separate with the result that the emulsion would again have a low flashpoint. This could result in a hazard and also in reduced cleaning effectiveness.

In addition to these major disadvantages, there are several other deficiencies macroemulsion cleaners have when used to clean industrial and marine equipment:

(a) The cleaners do not drain effectively which results in excessive post rinsing.

(b) The cleaners generate foam during the cleaning process.

(c) Cleaning effectiveness is sometimes inadequate.

(d) These cleaners are available only as a concentrate. The use of such concentrates requires on-site mixing.

The other major class of cleaners consist of detergents in solutions of water or solvents which also have limitations. Water-based formulations are ineffective on oil and soils. Solvent-based detergents possess flash points which render them hazardous when applied to thermally or electrically "live" equipment.

SUMMARY

This invention relates to microemulsion cleaners having decreased odor comprising:

(a) an organic solvent;

(b) a nonionic surfactant blend;

(c) a glycol ether;

(d) a phosphate ester hydrotrope or salt thereof;

(e) a primary amino alcohol; and (f) water.

These microemulsion cleaners show many advantages when compared to the macroemulsion cleaners currently used for industrial and marine cleaning. They can be formulated as concentrates, or as ready-to-use products by further dilution with water when manufactured. The ready-to-use cleaners do not have to be prepared at the application site, as do the more conventional unstable macroemulsions. The cleaners do not foam and are stable at temperatures up to 74° C. for at least several months. Additionally, the cleaners have decreased odor.

The cleaners are all purpose cleaners, and are highly effective for cleaning metals and air coolers. They effectively remove baked-on oil, carbon, and engine varnish deposits from metal surfaces, particularly steel. The cleaners are easy to handle, mildly alkaline and have a clear to slightly hazy appearance. Although the cleaners incorporate organic solvents and volatile corrosion inhibitors which have low flash points, they are safe to use because the addition of the primary amino alcohol increases or eliminates the flashpoint of the microemulsion cleaner up to 104° C. or the boiling point of the cleaner if the boiling point is lower than 104° C.

These cleaners are used in spray and soak cleaning. They are free draining and no heavy water rinse of cleaned equipment is required since these cleaners do not leave a milky residue. The cleaners also do not have an unpleasant odor as cleaners often do which contain morpholine instead of a primary amino alcohol. They also show improved cleaning power on aluminum surfaces when compared to cleaners containing morpholine.

ENABLING DISCLOSURE AND BEST MODE

Various organic solvents can be used in the microemulsion cleaners, such a aromatic and aliphatic organic solvents. These organic solvents are flammable or combustible organic solvents, yet, in the subject cleaners, their flash points are eliminated by the addition of primary amino alcohol and water.

Examples of suitable organic solvents are dichlorotoluene, monochlorotoluene, ortho dichlorobenzene, methyl naphthalene, alkyl acetate $C_6$ to $C_{13}$ esters such as Exxon EXXATE® 900 ($C_9$), 600 ($C_6$), 700 ($C_7$), 800 ($C_8$), 1000 ($C_{10}$), and 1300 ($C_{13}$) solvents, m-pyrol sold by GAF and BASF, and terpenes such as GLIDSOL® 180 sold by SCM and GLIDCO. Preferred solvents are Exxon aromatic solvents 200 and 200 ND (largely methyl naphthalene), dichlorotoluene sold by Oxy Chemical, Exxon EXXATE 900, and aromatic solvents containing substituted mono- and di-alkylnaphthalenes such as Amoco PANASOLAN-3S.

The amount of organic solvent used in the ready-to-use cleaner is from 5 to 40 weight percent, typically from 5–25 weight percent, preferably from 7–18 weight percent, and most preferably 10–12 weight percent, where said weight percent is based upon the total weight of the microemulsion cleaner. In the concentrate, typically from 10–30 weight percent, preferably 18 to 28 weight percent, where said weight percent is based upon the total weight of the microemulsion cleaner.

The nonionic surfactants are used in the microemulsion cleaners in weight ratios of 20:1 to 20:4, preferably 10:1 to 1:10, most preferably 4:1 to 1:4 based upon the total weight of the surfactants in the blend. The total amount of nonionic surfactant blend in the microemulsion cleaner is from 5 to 35 weight percent, preferably 10 to 25 weight percent, most preferably 12 to 20 weight percent.

These figures refer to the "ready to use" microemulsions. The concentrate preferably contains 7 to 50 weight percent, typically 10 to 40 weight percent, preferably 15–30 weight percent total surfactants.

The nonionic surfactants used in the nonionic surfactant blends are most typically reaction products of long-chain alcohols with several moles of ethylene oxide having an average molecular weight of about 300 to about 3000. One of the nonionic surfactants of the blend is a lower hydrophillic ethoxylate. The lower hydrophillic ethoxylate is linear alcohol ethoxylate where a $C_9$–$C_{11}$ and/or $C_{12}$–$C_{18}$ linear alcohol chain is ethoxylated with an average of 1.0 to 5.0 moles of ethylene oxide per chain, preferably 2.0 to 4.0 moles of ethylene oxide. The other nonionic surfactant of the nonionic surfactant blend is a higher ethoxylate. The higher ethoxylate is a linear alcohol ethoxylate where a $C_9$–$C_{11}$ and/or $C_{12}$–$C_{18}$ linear alcohol chain is ethoxylated with at least 6.0 moles of ethylene oxide per chain, preferably an average of 6.0 to 20.0 moles of ethylene oxide per chain, and most preferably an average of 6.0 moles to 12.0 moles of ethylene oxide per chain. The ratio of lower ethoxylate to higher ethoxylate is from 1:10 to 10:1, preferably from 1:4 to 4:1.

Most preferably used as the blend of nonionic surfactants are mixtures of $C_9$–$C_{11}$ linear alcohols ethoxylated with an average of 2.5, 6.0 and 8.0 moles of ethylene oxide per chain. The ratio of the 6 mole ethoxylates to 2.5 moles ethoxylates in the blend is preferably in the range of 1.5:1 to 2:1 and for 8 mole ethoxylates is in the range of 2.3:1. Useful linear ethoxylated alcohol surfactants are Shell NEODOL® 91-2.5, 91–6 and 91-8 surfactants which are shown in Table II.

For the "ready-to-use" formulations, generally at least 5 to 40 weight percent, preferably at least 10 to 30 weight percent, of the nonionic surfactant blend is required, said weight percent being based upon the weight of the microemulsion cleaner. Higher amounts can be used, but are less cost effective. For the microemulsion cleaner concentrates, generally from 5 to 40 weight percent of the nonionic is used, preferably 15 to 30 weight percent, assuming the presence of 10 weight percent water.

Glycol ethers which can be used in the microemulsion cleaners include such as dipropylene glycol monomethylether (DPM) or tripropylene glycol monomethylether (TPM). Preferably used as the glycol ether is DPM. If DPM is used, the amount of glycol ether used in the microemulsion cleaner is from 5 to 40 weight percent, preferably 10 to 25 weight percent, most preferably 18 to 22 weight percent, said weight percent is based upon the total weight of the microemulsion cleaner. For the concentrate, the quantity of DPM is preferably from 15–40 weight percent, most preferably 25–35 weight percent. If TPM is used, the amounts used are optimally about 15 percent greater than if DPM is used.

The microemulsion cleaner also contains a phosphate ester hydrotrope or salt thereof, preferably anionic phosphate ester hydrotrope, and most preferably the potassium salt of a phosphate ester hydrotrope. The amount of phosphate ester hydrotrope or salt thereof is from 1 to 10 weight percent, preferably 3 to 8 weight percent based upon the total weight of the microemulsion cleaner.

The microemulsion cleaners also contain a primary alcohol amine in an amount to effectively increase , or preferably eliminate , the flash point of the microemulsion cleaner. Generally, the amount of primary amino needed to increase and/or eliminate the flashpoint of the microemulsion cleaner is from 1 to 10 weight percent of primary amino alcohol, preferably 3 to 8 weight percent based upon the total weight of the microemulsion cleaner. The weight percent will vary depending upon the basicity of the primary amino alcohol. Weaker bases will require more primary amino alcohol. Although more than 10 weight percent of primary amino alcohol can be used, amounts more than 10 weight percent are not usually cost effective. Preferably used as the primary amino alcohol are 2-amino-2-methyl-1-propanol, 2-amino-2-ethyl-1,3-propanediol, 2-amino-1-butanol, 2-amino-2-methyl-1,3-propanediol, tris(hydroxymethyl) aminomethane and 2-dimethyl-amino-2-methyl-propanol. Methylation of primary amino alcohols can yield secondary and tertiary amines. As a result, some of these secondary and tertiary amines may be present in the formulation, In addition to flashpoint inhibition, the primary amino alcohol acts as a vapor phase, contact phase, and interphase corrosion inhibitor in the cleaner equipment by inhibiting flash rusting which is often observed after conventional cleaning.

Also, the primary amino alcohol acts as a corrosion inhibitor in the microemulsion cleaner, due to the pH of the cleaner, for copper and aluminum as well as for steel. All three metals may be present in the equipment to be cleaned with the microemulsion cleaners.

The microemulsion cleaners also contain water. The amount of water in the cleaner depends upon whether one is formulating a concentrate or a ready-to-use cleaner. The amount of water the concentrate is from 3 to 25 weight percent, preferably 5 to 15 weight percent, most preferably 7 to 14 weight percent, said weight percent is based upon the total weight of the microemulsion cleaner concentrate.

The amount of water used in the ready-to-use cleaner is from 25 to 60 weight percent, preferably 35 to 60, most preferably 45 to 55, said weight percent is based upon the total weight of the microemulsion cleaner.

The microemulsion may also contain a defoamer. A wide variety of defoamers can be used in the microemulsion cleaner. Typically used as defoamers are polydimethyl siloxane type compounds. A specific example is DREWPLUS® L-8905 defoamer. The amount of defoamer used in the microemulsion cleaner is from 0.001 to 0.5 weight percent, preferably 0.02 to 0.2 weight percent, most preferably 0.05 to 0.1 weight percent, said weight percent is based upon the total weight of the microemulsion cleaner.

Preferably, the microemulsion ready-to-use cleaners comprise:

(a) from about 10 to 12 weight percent of an organic solvent, particularly aromatic and aliphatic hydrocarbon solvents such as dichlorotoluene, terpene hydrocarbon, oxyalcohol esters, M-pyrol, and substituted mono- and di- alkylnaphthalenes;

(b) from about 12 to 20 weight percent of a nonionic surfactant blend wherein the weight ratio of nonionic surfactant blend is from 1:4 to 4:1 with the nonionic surfactant blend being at least 17 weight percent of the microemulsion cleaner;

(c) from about 18 to 22 weight percent of DPM;

(d) from about 3 to 8 weight percent of an anionic phosphate ester hydrotrope or salt thereof;

(e) from 1 to 10 weight percent of 2-amino-2- methyl-1-propanol;

(f) from 0.001 to 0.1 weight percent of a defoamer; and (g) from 35 weight percent water for the concentrate and up to 60 percent by weight of water for the ready-to-use microemulsion cleaner.

All weight percents are based upon the total weight of the microemulsion cleaner.

One of the surprising aspects of this invention is that the microemulsion cleaners do not have flash points (they instead cause a flame to be extinguished) even though the components of the microemulsions do, i.e. typical organic solvents have flash point in the range 10° C. to 100° C. For instance, 2-amino-2-methyl-1-propanol has a flash point of 83° C., and glycol ethers such as DPM has a flash point of 74° C.

The microemulsion concentrates described here can be used in a variety of other cleaning applications, such as storage tanks, pipes, and internal parts of pumps used to transfer liquid which require cleaning with cleaning products that have no flash point. They can also be used as an "engine shampoo" cleaner. In this application, the defoamer is left out since foaming is desirable in this type of cleaner.

It is believed that the enhanced cleaning effect of the microemulsion cleaners may relate to the presence of ultrafine droplets, either water-in-oil and/or oil-in water, having diameters of 0.001 micron to 0.01 micron, which are stable in the microemulsion cleaner. The transparency and clarity of the microemulsion cleaner are evidence of this stability.

ABBREVIATIONS

The following abbreviations are used in the Examples:

ACC-9=A macroemulsion cleaner sold by Drew Marine Division of Ashland Chemical, Inc. The formulation is described in Table I as the Control (CNT). Aromatic 200 ND=a mixture mainly of methyl naphthalenes sold by Exxon AMP=2-amino-2- methyl -1-propanol Aromatic 200=similar to Aromatic 200ND except it contains up to about 10 weight percent of naphthalene DCT Technical=a mixture of isomers of dichlorotoluene DOWANOL DPM=dipropylne glycol methyl ether DREWPLUS® L-8905=a defoamer based upon dimethylsiloxane sold by Drew Industrial EXXATE 900=$C_9H_{19}OCOH_3$, also known as alkyl acetate (oxo-nonxyl acetate)

Fuel Oil #2=a mixture of aliphatic and aromatic hydrocarbons sold as heating fuel Fuel Oil #6=a heavy oil, highly viscous, used as a fuel in low speed diesel engines, etc.

GLIDSOL 180=a terpene blend sold by SCM/GLIDCO

MPD-13-117=a nonionic surfactant which is the reaction product of coco fatty acid and diethanol amine, sold by Mona, Heterene, etc.

MPY=a unit of corrosion, where 1 MPY equals 1/1000 of an inch corrosion per year PANASOL AN-3S=an aromatic hydrocarbon that contains substituted mono- and di-alkylnaphthalenes.

Neodol 91-8=a nonionic surfactant which is the reaction product of $C_9$–$C_{11}$ linear alcohols with ethoxylates averaging 8.2 ethylene oxide units per molecule sold by Shell Oil Company Neodol 91-2.5=a nonionic surfactant which is the reaction product of $C_9$–$C_{11}$ linear alcohols with ethoxylates averaging 2.5 ethylene oxide units per molecule sold by Shell Oil Company Neodol 91-6=a nonionic surfactant which is the reaction product of $C_9$–$C_{11}$ linear alcohols with ethoxylates, averaging 6 ethylene oxide units per molecule sold by Shell Oil Company TRITON H-66=anionic hydrotrope/solubilizer surfactant which is a potassium salt of phosphate ester hydrotrope ULTRAWET 45DS=a solution of 45 weight percent sodium dodecyl benzene sulfonate in water

EXAMPLES

The examples will describe the "ready-to-use" microemulsion cleaners and concentrates. Static Soak Evaluation Test (SSET) procedures used to evaluate the microemulsion cleaners are described as follows:

STATIC SOAK EVALUATION TEST (SSET) FOR CLEANING FUEL OIL #6 DEPOSITS

The test procedure for static soak evaluation testing is as follows:

1. Stainless steel coupons (size 7.5×1.30 cm) are coated with fuel oil #6 and the weight of the oil on the coupon is measured.
2. Four ounce jars containing candidate cleaners are prepared. Tap water is used as a "blank".
3. The oil coated coupons are placed in 4 oz jars. The jars are placed on a counter without shaking. The cleaning is performed at room temperature 25° C./77° F. or at 55° C./130° F.
4. One set of coupons is removed from the cleaning solutions after 3 hours and the other set after 6 hours of cleaning. The coupons are then allowed to dry to a constant weight and the final weight is measured. When cleaning is performed at 55° C./131° F. after 10 minutes of static soak cleaning, 100% cleaning performance must be achieved with optimum formulation.
5. Based on weight loss of fuel oil #6, cleaning performance of the cleaners was calculated:

$$\frac{A-B}{A} \times 100 = \%\text{ oil deposit removed}$$

where A is the initial weight of the fuel oil #6 and B is the final weight of fuel oil #6.

In this test, the # 6 oil was first baked-on the coupon by heating to 60° C. for 30 minutes.

CONTROL

Table I gives the formulation of a commercially available water macroemulsion cleaner (CONTROL A). The macroemulsion cleaner is prepared by blending 33% ACC-9 and 67% water. The macroemulsion is stable for 2–4 hours, but must be mixed just prior to use.

TABLE I

| FORMULATION OF ACC-9 CONTROL A: (macroemulsion cleaner in 33 grams ACC-9 and 67 grams water) | |
|---|---|
| Component | Amount |
| DCT Technical | 60.0 |
| Fuel Oil #2 | 32.5 |
| MPD 13-117 | 7.5 |
| Dyes | 0.001 |

The flashpoint of this macroemulsion cleaner is about 77° C.

Table II gives the formulations of two microemulsion cleaners containing AMP. CONTROL B (CB) is a similar cleaner except it contains morpholine instead of AMP.

TABLE II

| COMPONENT | CB | 1 | 2 |
|---|---|---|---|
| Aromatic 200/Aromatic 200 ND/PANASOL AN-3S | 5.25 | 6.00 | 12.00 |
| Exxate 900 | 5.25 | 6.00 | — |
| Dowanol DPM | 20.0 | 20.0 | 20.0 |
| Morpholine | 7.5 | — | — |
| AMP-95 | — | 2.5 | 2.5 |
| Triton H-66 | — | 5.5 | 5.5 |
| Ultrawet 45DS | 5.0 | — | — |
| Neodol 91-6 | 6.0 | 0 | — |
| Neodol 91-8 | — | 11.0 | 11.5 |
| Neodol 91-2.5 | 4.0 | 5.0 | 5.0 |
| Water (demineralized) | 46.95 | 43.95 | 43.45 |
| Drewplus L-8905 | 0.05 | 0.05 | 0.05 |
| Flame Extinguished | 65° | 85° C. | 80° C. |

There was no flashpoint as determined by the Pensky-Martin test for the microemulsion cleaners of Examples 1–2 and the CONTROL B (CB). However Control B, which contained morpholine had an unpleasant odor. The cleaners of Examples 1–2 did not have an unpleasant odor.

Table III gives SSET results for CONTROL A (the macroemulsion cleaner known as ACC-9), CONTROL B, and the cleaners of Examples 1–2. The results show that the cleaners of CONTROL B and Examples 1–2 are more effective than the CONTROL A. In fact, based on SSET results, the cleaners of Examples 1, 2, and CONTROL B are superior to the CONTROL A, except that CONTROL B, which contains morpholine, has an unpleasant odor.

TABLE III

| | EXAMPLE NUMBER | | | |
|---|---|---|---|---|
| COMPONENT | CONTROL A | CONTROL B | 1 | 2 |
| % Oil #6 Removed - Spray Tank Cleaning Method | 74.3 | 100% | 100% | 100% |
| % Oil #6 Removed - Soak Method after three hours soak | 69.0 | 100% | 100% | 100% |

The SSET was also conducted on small automobile engine parts which were cleaned for 37 minutes at 55° C. by immersing the pats in CONTROL B, & Examples 1 and 2. All three cleaners removed 100% of the oily grime after 37 minutes.

These tests illustrate the greatest challenge for the subject microemulsion cleaners. Baked-on carbon deposits are a particularly difficult class of deposits to clean and are found on various diesel and automotive parts, i.e. valves and valve stems, injectors, tips, nozzles, carburetors, etc.

Until now, the most effective products used to clean these parts contained cresylic acid and chlorinated solvents such as methylene chloride and chlorobenzene. Such solvents as well as cresylic acid, are now being banned by various regulatory agencies placing the ship or automotive engineer in a difficult predicament.

CONTROL B and Examples 1 and 2 are more effective than any of these. They clean quickly, and easily remove such carbon deposits from carburetors, valves, nozzles and valve stems, injectors, etc. However, the cleaners of Examples 1 and 2 did not have an unpleasant odor as did CONTROL B.

Another advantage of the microemulsion cleaners is that they can heated up to 60° C. for faster cleaning with light brushing to remove baked-on carbonized deposits since they do not have flashpoints. They are more powerful in this regard than any known "carbon removers" such as those containing cresylic acid, caustic, methylene chloride, etc. They are also far less toxic, and environmentally more desirable.

Table IV shows the corrosion rate (CR) for the cleaners of CONTROL B and Examples 1 and 2 on aluminum in mils per year (MPY) over 24 hours at temperatures of 25° C. and 55° C.

TABLE IV

| Example | CR at 77° F. | CR at 130° F. |
|---|---|---|
| CONTROL B | 1.21 | 1.45 |
| EXAMPLE 1 | 0.48 | 0.24 |
| EXAMPLE 2 | 0.73 | 0.97 |

The data in Table IV indicate that the corrosion rate on aluminum is reduced if AMP (see Examples 1 and 2) is substituted for morpholine.

I claim:

1. A ready-to-use microemulsion cleaner comprising:

(a) an organic solvent selected from the group consisting of dichlorotoluene, terpene hydrocarbon, aromatic hydrocarbon, oxyalcohol esters, m-pyrol, and mixtures thereof in an amount of from 7 to 18 weight percent;

(b) a nonionic surfactant blend comprising from about 10 to 25 weight percent of said cleaner, where said blend comprises (i) a lower ethoxylate of a linear alcohol having a carbon chain selected from the group consisting of $C_9$–$C_{11}$, $C_{12}$–$C_{18}$, or mixtures thereof, ethoxylated with an average of 2.0 to 4.0 moles of ethylene oxide, and (ii) a higher ethoxylate of a linear alcohol having a carbon chain selected from the group consisting of $C_9$–$C_{11}$, $C_{12}$–$C_{18}$, or mixtures thereof, ethoxylated with an average of 6.0 to 12.0 moles of ethylene oxide per chain wherein the ratio of (i) to (ii) is from 1:4 to 4:1;

(c) a glycol ether in an amount of 5 to 40 weight percent;

(d) an anionic phosphate ester hydrotrope or salt thereof in an amount of 3 to 20 weight percent;

(e) a primary amino alcohol selected from the group consisting of 2-amino-2-methyl-1-propanol, 2-amino-2-ethyl-1, 3-propanediol, 2-amino-1-butanol, 2-amino-2-methyl-1, 3-propanediol, tris(hydroxymethyl) aminomethane and 2-dimethyl-amino-2-methyl-propanol in an amount of 1 to 10 weight percent in amount effective to increase the flashpoint of said microemulsion cleaner; and (f) water in an amount of 25 to 60 weight percent, said weight percent is based upon the total weight of the ready-to-use microemulsion cleaner.

2. The ready-to-use cleaner of claim 1 which also contains a polysiloxane defoamer in an amount of 0.001 to 0.5 weight percent, wherein said weight percent is based upon the weight of the ready-to-use microemulsion cleaner.

3. The ready-to-use microemulsion cleaner of claim 2 wherein:

(a) the organic solvent is selected from the group consisting of dichlorotoluene, terpene hydrocarbon, aromatic hydrocarbon, oxyalcohol esters, m-pyrol, and mixtures thereof in an amount of from 7 to 18 weight percent;

(b) the nonionic surfactant blend comprises from about 10 to 25 weight percent of said cleaner, and said blend comprises (i) an ethoxylate of a linear alcohol having a carbon chain selected from the group consisting of $C_9$–$C_{11}$, $C_{12}$–$C_{18}$, or mixtures thereof, ethoxylated with an average of 2.0 to 4.0 moles of ethylene oxide, and (ii) an ethoxylate of a linear alcohol having a carbon chain selected from the group consisting of $C_9$–$C_{11}$, $C_{12}$–$C_{18}$, or mixtures thereof, ethoxylated with an average of 6.0 to 12.0 moles of ethylene oxide per chain wherein the ratio of (i) to (ii) is from 1:4 to 4:1;

(c) the glycol ether is in an amount of from 18 to 22 weight percent;

(d) the phosphate ester or salt thereof is an anionic phosphate ester hydrotrope potassium salt in an amount of 3 to 8 weight percent;

(e) the primary amino alcohol is 2-amino-2-methyl-1-propanol in an amount of 3 to 8 weight percent;

(f) the defoamer is present in an amount of from 0.001 to 0.1 weight percent; and (g) water in an amount of from 45 to 55 weight percent, said weight percent being based upon the total weight of the ready-to-use cleaner.

4. The ready-to-use microemulsion cleaner of claim 3 wherein said nonionic surfactant blend contains from 8 to 17 weight percent of nonionic surfactant.

5. A microemulsion cleaner concentrate comprising:

(a) an organic solvent selected from the group consisting of dichlorotoluene, terpene hydrocarbon, aromatic hydrocarbon, oxyalcohol esters, m-pyrol, and mixtures thereof in an amount of from 10 to 40 weight percent;

(b) a nonionic surfactant blend in an amount of 5 to 40 weight percent where said blend comprises (i) a lower ethoxylate of a linear alcohol having a carbon chain selected from the group consisting of $C_9$–$C_{11}$, $C_{12}$–$C_{18}$, or mixtures thereof, ethoxylated with an average of 2.0 to 4.0 moles of ethylene oxide, and (ii) a higher ethoxylate of a linear alcohol having a carbon chain selected from the group consisting of $C_9$–$C_{11}$, $C_{12}$–$C_{18}$, or mixtures thereof, ethoxylated with an average of 6.0 to 12.0 moles of ethylene oxide per chain wherein the ratio of (i) to (ii) is from 1:4 to 4:1;

(c) a glycol ether in an amount of 15 to 40 weight percent;

(d) an anionic phosphate ester hydrotrope or salt thereof in an amount of 4 to 11 weight percent;

(e) a primary amino alcohol selected from the group consisting of 2-amino-2-methyl-1-propanol, 2-amino-2-ethyl-1, 3-propanediol, 2-amino-1-butanol, 2-amino-2-methyl-1, 3-propanediol, tris(hydroxymethyl) aminomethane and 2-dimethyl-amino-2-methyl-propanol in an amount of 1 to 10 weight percent in amount effective to increase the flashpoint of said microemulsion cleaner; and (f) water in an amount of 3 to 25 weight percent, said weight percent is based upon the total weight of the ready-to-use microemulsion cleaner.

6. The microemulsion cleaner concentrate of claim 5 which also contains a polysiloxane defoamer in an amount of 0.001 to 0.5 weight percent, wherein said weight percent is based upon the weight of the microemulsion cleaner concentrate.

7. The microemulsion cleaner concentrate of claim 6 wherein:

(a) the organic solvent is selected from the group consisting of dichlorotoluene, terpene hydrocarbon, aromatic hydrocarbon, oxyalcohol esters, m-pyrol, and mixtures thereof in an amount of from 18 to 25 weight percent;

(b) the nonionic surfactant blend comprises from about 10 to 25 weight percent of said cleaner, and said blend comprises (i) an ethoxylate of a linear alcohol having a carbon chain selected from the group consisting of $C_9$–$C_{11}$, $C_{12}$–$C_{18}$, or mixtures thereof, ethoxylated with an average of 2.0 to 4.0 moles of ethylene oxide, and (ii) an ethoxylate of a linear alcohol having a carbon chain selected from the group consisting of $C_9$–$C_{11}$, $C_{12}$–$C_{18}$, or mixtures thereof, ethoxylated with an average of 6.0 to 12.0 moles of ethylene oxide per chain wherein the ratio of (i) to (ii) is from 1:4 to 4:1;

(c) a glycol ether in an amount of from 30 to 35 weight percent;

(d) an anionic phosphate ester hydrotrope or salt thereof in an amount of 4 to 11 weight percent;

(e) the primary amino alcohol is 2-amino-2- methyl-1-propanol in an amount of 3 to 8 weight percent;

(f) the defoamer is present in an amount of from 0.001 to 0.1 weight percent; and (g) water in an amount of from 5 to 15 weight percent, said weight percent being based upon the total weight of the microemulsion cleaner concentrate.

8. The microemulsion cleaner concentrate of claim 7 wherein the nonionic surfactant blend contains from 8 to 30 weight percent of nonionic surfactants.

* * * * *